US009286815B1

(12) United States Patent
Smith

(10) Patent No.: US 9,286,815 B1
(45) Date of Patent: Mar. 15, 2016

(54) STOP SIGN APPARATUS

(71) Applicant: Dale E. Smith, San Bernardino, CA (US)

(72) Inventor: Dale E. Smith, San Bernardino, CA (US)

( * ) Notice: Subject to any disclaimer, the term of this patent is extended or adjusted under 35 U.S.C. 154(b) by 176 days.

(21) Appl. No.: 14/225,832

(22) Filed: Mar. 26, 2014

(51) Int. Cl.

| | |
|---|---|
| ***G09F 21/02*** | (2006.01) |
| ***G09F 19/12*** | (2006.01) |
| ***F21K 99/00*** | (2010.01) |
| ***G09F 13/04*** | (2006.01) |

(52) U.S. Cl.
CPC . *G09F 19/12* (2013.01); *F21K 9/00* (2013.01); *G09F 13/04* (2013.01)

(58) Field of Classification Search
CPC ..... G09F 21/02; G09F 13/005
See application file for complete search history.

(56) References Cited

U.S. PATENT DOCUMENTS

| | | | | |
|---|---|---|---|---|
| 5,687,500 | A | 11/1997 | Lamparter | |
| 6,031,468 | A | 2/2000 | Tsao et al. | |
| 6,204,777 | B1 * | 3/2001 | Lyons | G08G 1/0955 340/321 |
| 6,409,358 | B1 | 6/2002 | Grover | |
| 6,796,062 | B1 * | 9/2004 | deKoevend | G09F 7/00 116/63 P |
| 9,153,149 | B1 * | 10/2015 | Curtiss | G09F 13/005 |

* cited by examiner

*Primary Examiner* — Elmito Breval
(74) *Attorney, Agent, or Firm* — Crossley Patent Law

(57) ABSTRACT

A portable stop sign apparatus with attention-getting features to warn motorists of pedestrians in a walkway, the sign having a front side and a rear side, each of which have top portion containing a single pedestrian symbol structure lighted by strobe lights, a center portion containing a plurality of pedestrian symbol structures lighted sequentially from left to right to resemble a walking pedestrian, and a bottom portion having a lighted "STOP" lighting structure. The stop sign is mounted on a pole that is mounted to a stand, the pole having a pole plug on a lower end thereof that engages a stand plug. A battery housing is disposed atop the stand.

7 Claims, 4 Drawing Sheets

STOP SIGN APPARATUS

BACKGROUND OF THE INVENTION

Attention-getting devices to inform motorists of potential hazards, such as poor road conditions, emergency situations, and pedestrians in crosswalks, are needed in addition to the typical street and highway signals and signs. Pedestrian crossings, for example, are areas in which motorists must be attentive to potential hazards involving pedestrians. While stop signs and traffic laws exist to inform motorists of such hazards, additional informative devices have proven effective. A need is therefore established for an attention-getting sign with warnings to stop and to heed pedestrians in a crosswalk utilizing a combination of lights and symbol structures toward this endeavor. The present portable apparatus provides a unique combination of lights and symbol structures to inform motorists of potential hazards.

FIELD OF THE INVENTION

The present stop sign apparatus relates to signs and, more particularly, to a portable, lighted sign to warn motorists of driving hazards.

SUMMARY OF THE INVENTION

The general purpose of the stop sign apparatus, described subsequently in greater detail, is to provide a stop sign apparatus which has many novel features that result in an improved stop sign apparatus which is not anticipated, rendered obvious, suggested, or even implied by prior art, either alone or in combination thereof.

To attain this, the stop sign apparatus provides a portable sign for warning motorists. The present apparatus provides motorists with a warning for pedestrians. The present apparatus includes an octagonally-shaped sign and is lighted on each of the front and rear sides of the sign. A top one-third portion of the sign includes a single pedestrian symbol structure that is lighted with adjacent strobe lights. A center one-third portion of the sign contains an animated field including a plurality of pedestrian symbol structures appearing to walk across the sign. The lower one-third portion of the sign includes a transparent "STOP" lighting structure containing a word "STOP" lighted with a plurality of light emitting diodes. An externally accessible switch on the pole provides convenience to control lighting. The pole selectively removes from the stand. A rechargeable battery provides a power source via a pole plug disposed in a lower end of the stand that engages a stand plug disposed within the stand. The lightweight portability of the apparatus permits use in a variety of circumstances and environments.

While various shaped poles are offered, the present apparatus provides a round pole. Other embodiments can replace the word "STOP" with "CAUTION", "DETOUR", and other warning functions, with an appropriate animated field. Additionally, various connections between the pole and the battery housing are available, while the preferred connection is a two-pronged male plug on the pole with a female counterpart in the plug housing top of the stand.

Thus has been broadly outlined the more important features of the improved stop sign apparatus so that the detailed description thereof that follows may be better understood and in order that the present contribution to the art may be better appreciated.

DETAILED DESCRIPTION OF THE DRAWINGS

With reference now to the drawings, and in particular FIGS. 1 through 4 thereof, the principles and concepts of the stop sign apparatus generally designated by the reference number 10 will be described.

Figure 1:
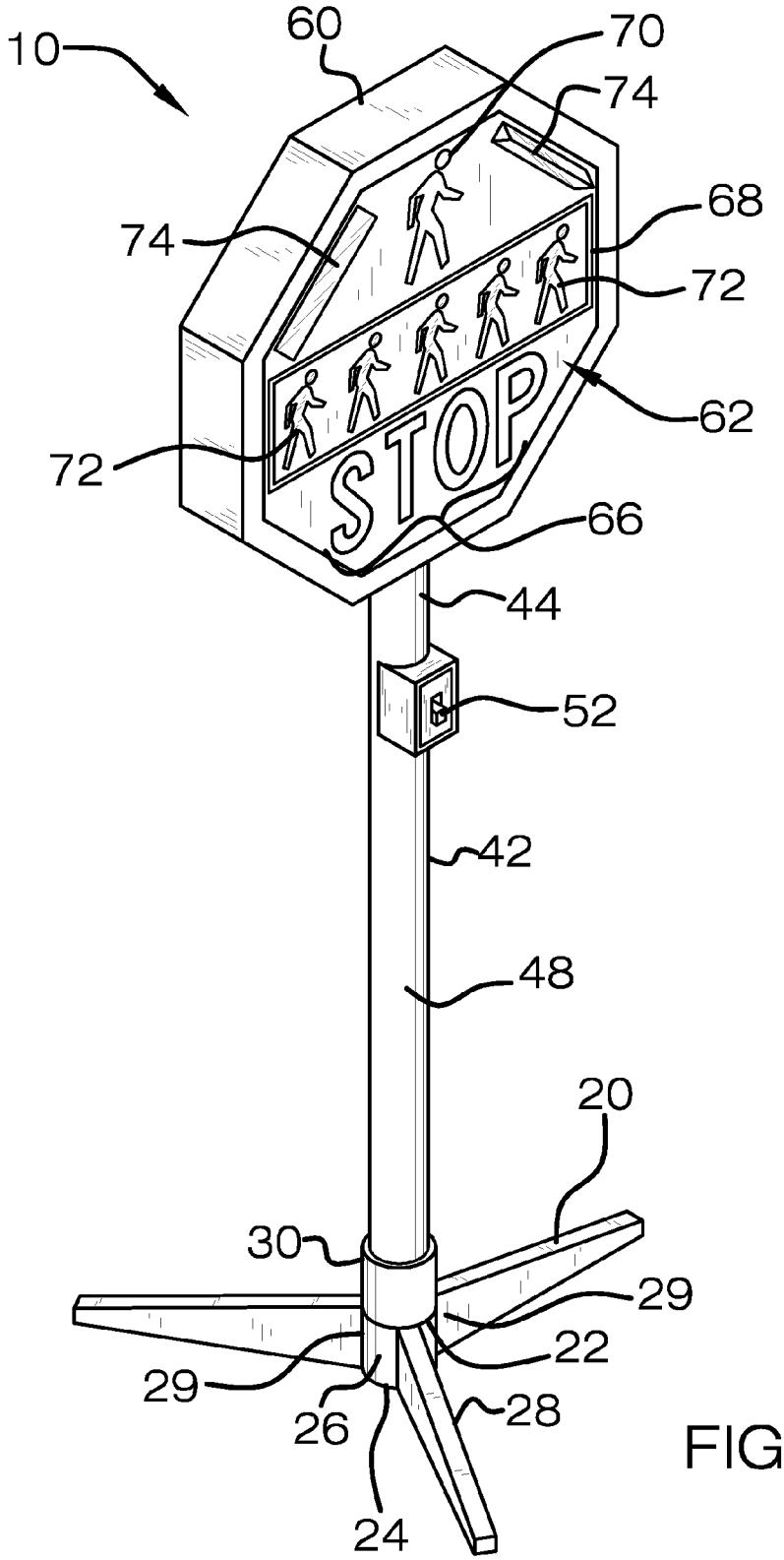
FIG. 1 is a perspective front view.
Figure 2:
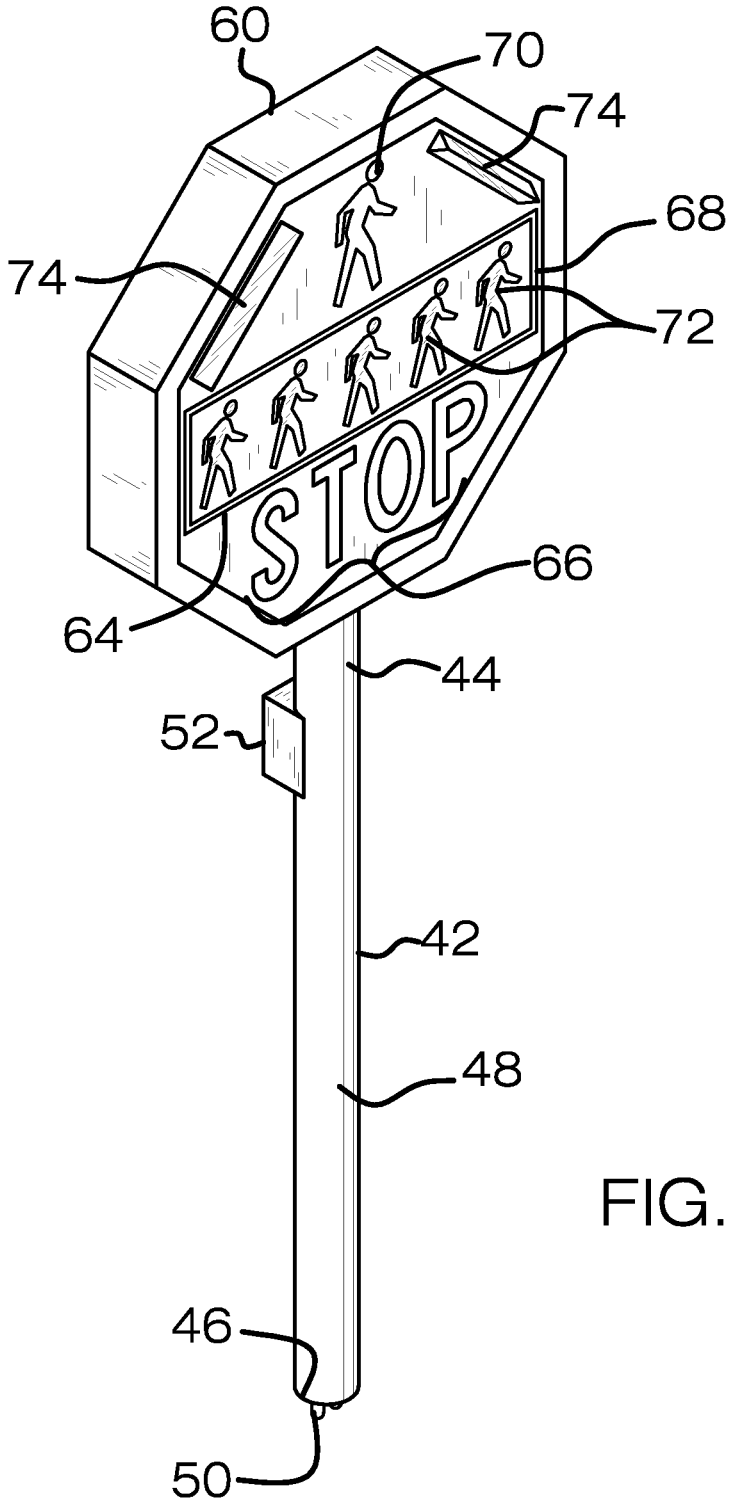
FIG. 2 is a perspective rear view shown without a stand.
Figure 3:
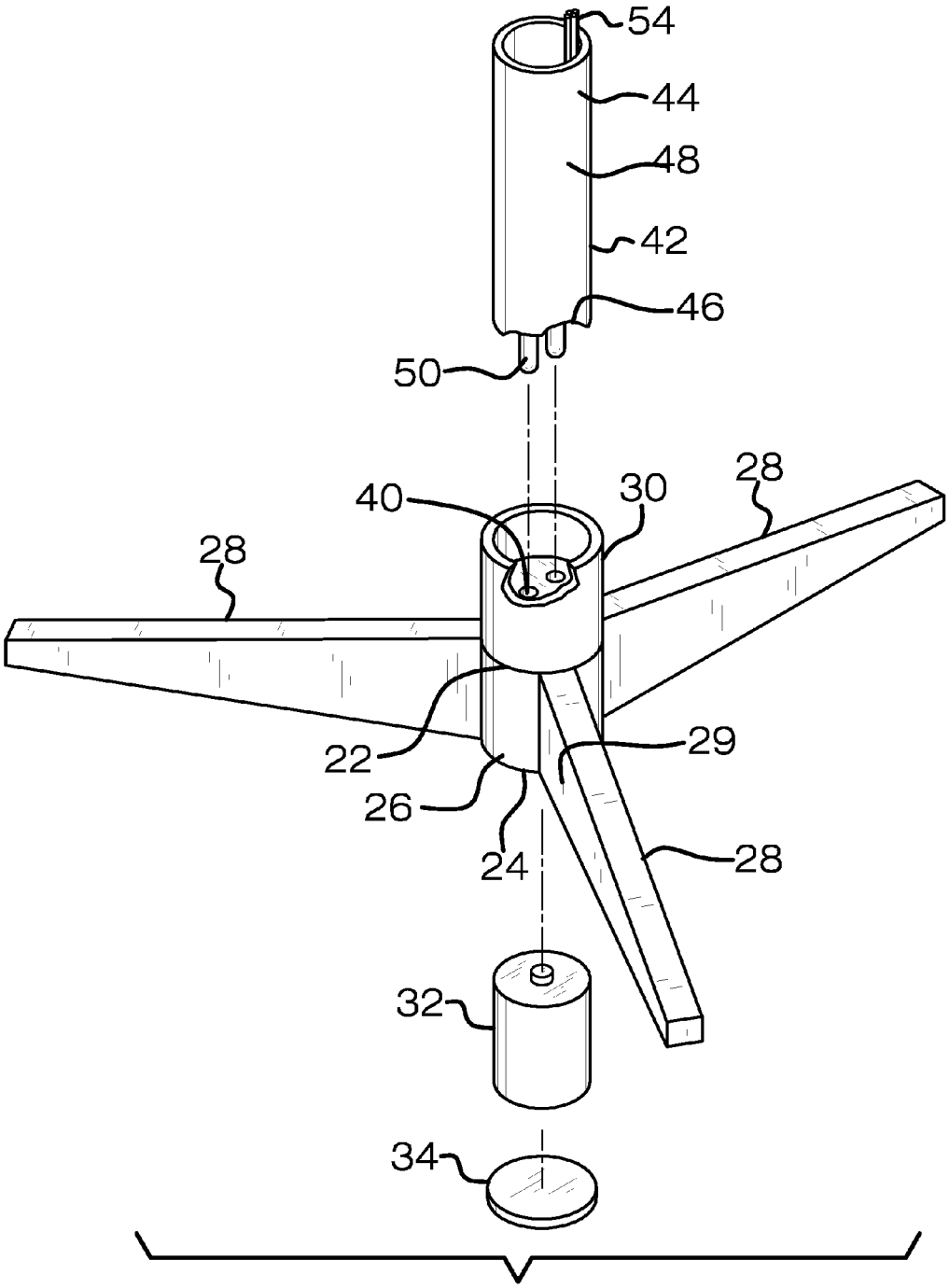
FIG. 3 is an exploded perspective view showing the insertion of a pole into a plug housing.
Figure 4:
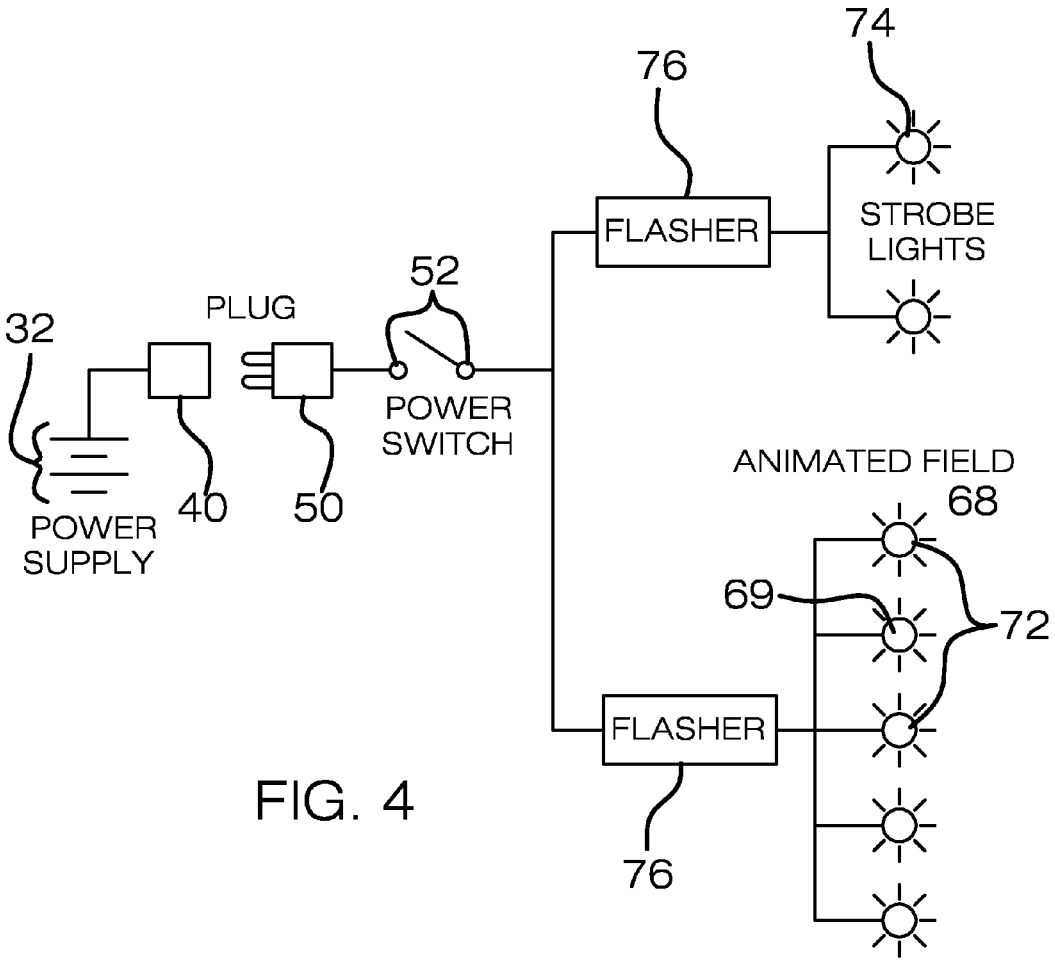
FIG. 4 is block diagram view of operations.

Referring to FIG. 3, the stop sign apparatus 10 partially comprises a stand 20. The stand 20 has a top end 22, a bottom end 24, and an annular battery housing 26 centrally disposed therebetween. The stand 20 is an annular structure. A plurality of legs 28 is provided to support the stand 20 in an upright position during use. Each leg 28 has a proximal end 29 disposed on the battery housing 26. As illustrated, the stand 20 has three legs 28.

An open-topped plug housing 30 is disposed on the top end 22 of the stand 20. A rechargeable battery 32 is removably disposed within the battery housing 26 to provide a power source that enables the apparatus 10 to be moved to various locations. A cap 34 removably engages the bottom end 24 of the stand 20 to protect the battery 32 contained within the battery housing 26. A stand plug 40 is disposed within the plug housing 30. The stand plug 40 is preferably female.

A hollow pole 42 is supported by the stand 20. The pole 42 has an upper end 44, a lower end 46, and a length 48 disposed therebetween. The lower end 46 removably engages the plug housing 30. The plug housing 30 has a diameter that provides a slideable, and snug fit for the lower end 46 of the pole 42.

A pole plug 50 is disposed within the lower end 46 of the pole 42. The pole plug 50 operationally engages the stand plug 40. The pole plug 50 is preferably a two-pronged male plug.

An externally accessible power switch 52 is disposed on the pole 42, preferably proximal the upper end 44. A connect wire 54 disposed within the pole 42 is in operational communication between the power switch 52 and the other electrical components of the apparatus 10.

An octagonal sign 60 is disposed on the upper end 44 of the pole 42. The sign 60 has a front side 62 and a rear side 64. Each of the front side 62 and the rear side 64 of the sign 60 includes a transparent "STOP" lighting structure 66 disposed on an approximate lower one-third portion, an animated field 68 disposed on an approximate middle one-third portion; and a single pedestrian symbol structure 70 disposed on an approximate top one-third portion. The "STOP" lighting structure 66 comprises the word "STOP" lighted by a plurality of light emitting diodes 69. The animated field 68 comprises a plurality of horizontally disposed spaced apart transparent pedestrian symbol structures 72 that are sequentially lighted from left to right by a plurality of second light emitting diodes to animate the symbol structures 72 in a sequence resembling walking.

In addition, a pair of spaced apart strobe lights 74 is disposed within the top one-third portion of each of the front side 62 and the rear side 64 of the sign 60. One strobe light 74 is disposed on each side of the pedestrian symbol structure 70. Each strobe light 74 is preferably directed toward the single pedestrian symbol 70 and, therefore, also lights the remainder of the sign 60. The connect wire 54 in is operational communication with the power switch 52, the strobe lights 74, the "STOP" lighting structure 62, the animated field 68, and the battery 32, all of which are operationally interconnected.

A flasher 76 is in operational control of each of the strobe lights 74 and the animated field 68 upon activation of the power switch 52.

The plug housing 30 and the pole 42 are preferably cylindrical as illustrated.

What is claimed is:

1. A stop sign apparatus comprising:

a stand having a top end, a bottom end and a battery housing centrally disposed therebetween;

a plurality of legs having a proximal end disposed on the battery housing;

a rechargeable battery disposed within the compartment;

a cap removably engaging the bottom end of the stand, wherein the cap is configured to protect the battery disposed within the compartment;

an open-topped plug housing disposed on the top end of the stand;

a stand plug disposed within the plug housing;

a hollow pole having an upper end, a lower end, and a length disposed therebetween, the lower end removably engaging the plug housing;

a pole plug disposed within the lower end of the pole, wherein the pole plug operationally engages the stand plug;

an externally accessible power switch disposed on the pole;

an octagonal sign disposed on the upper end of the pole, the sign having a front side and a rear side, each of the front side and the rear side comprising:

a transparent "STOP" lighting structure disposed on an approximate lower one-third portion, the "STOP" lighting structure comprising a word STOP illuminated by a plurality of first light emitting diodes;

an animated field disposed on an approximate middle one-third portion, the animated field comprising a plurality of horizontally disposed spaced apart transparent pedestrian symbol structures sequentially lighted from left to right by a plurality of second light emitting diodes lighting of the symbols;

a single pedestrian symbol structure in an approximate top one-third portion;

a power source;

a power source switch in operational communication with the power source; and a connect wire disposed within the pole, the connect wire being in operational communication with the power source, the "STOP" lighting structure, the animated field, the pedestrian symbol, and the power source switch;

wherein the legs are configured to support the pole and the sign in an upright position during use.

2. The stop sign apparatus of claim 1 further comprising:

a pair of spaced apart strobe lights disposed within the top one-third portion of each of the front and rear sides of the sign, wherein one of the strobe lights is disposed on each side of the pedestrian symbol structure; and the connect wire further in operational communication with the strobe lights.

3. The stop sign apparatus of claim 1:

wherein the pole plug comprises a two-pronged male plug; and wherein the stand plug comprising a female plug.

4. The stop sign apparatus of claim 2 further comprising:

a flasher in operational control of each of the strobe lights and the animated field upon activation of the power switch.

5. The stop sign apparatus of claim 4:

wherein the pole plug comprises a two-pronged male plug; and wherein the stand plug comprising a female plug.

6. The stop sign apparatus of claim 2:

wherein the pole plug comprises a two-pronged male plug; and wherein the stand plug comprising a female plug.

7. A stop sign apparatus comprising:

an annular stand having a top end, a bottom end and an annular battery housing centrally disposed therebetween;

a plurality of legs having a proximal end disposed on the battery housing, wherein the legs comprise three spaced apart legs;

a rechargeable battery disposed within the compartment;

a cap removably engaging the bottom end of the stand, wherein the cap is configured to protect the battery disposed within the compartment;

an open-topped cylindrical plug housing disposed on the top end of the stand;

a female stand plug disposed within the plug housing;

a hollow cylindrical pole having an upper end, a lower end, and a length disposed therebetween, the lower end removably engaging the plug housing;

a two-pronged male pole plug disposed within the lower end of the pole, wherein the pole plug operationally engages the stand plug;

an externally accessible power switch disposed on the pole proximal the upper end of the pole;

an octagonal sign disposed on the upper end of the pole, the sign having a front side and a rear side, each of the front side and the rear side comprising:

a transparent "STOP" lighting structure disposed on an approximate lower one-third portion, the "STOP" lighting structure comprising a word STOP illuminated by a plurality of first light emitting diodes;

an animated field disposed on an approximate middle one-third portion, the animated field comprising a plurality of horizontally disposed spaced apart transparent pedestrian symbol structures sequentially lighted from left to right by a plurality of second light emitting diodes lighting of the symbols;

a single pedestrian symbol in an approximate top one-third portion;

a pair of spaced apart strobe lights disposed within the top one-third portion of each of the front and rear sides of the sign, wherein one of the strobe lights is disposed on each side of the pedestrian symbol structure, wherein the strobe lights are directed toward the pedestrian symbol structure;

a power source;

a power source switch in operational communication with the power source;

a connect wire disposed within the pole, the connect wire being in operational communication with the power source, the "STOP" lighting structure, the animated field, the pedestrian symbol, the strobe lights, and the power source switch; and a flasher in operational control of each of the strobe lights and the animated field upon activation of the power switch;

wherein the legs are configured to support the pole and the sign in an upright position during use.

* * * * *